US005127030A

United States Patent [19]

Annis et al.

[11] Patent Number: 5,127,030

[45] Date of Patent: * Jun. 30, 1992

[54] TOMOGRAPHIC IMAGING WITH IMPROVED COLLIMATOR

[75] Inventors: Martin Annis, Cambridge; Roderick Swift, Belmont, both of Mass.

[73] Assignee: American Science and Engineering, Inc., Cambridge, Mass.

[ * ] Notice: The portion of the term of this patent subsequent to Feb. 28, 2006 has been disclaimed.

[21] Appl. No.: 526,541

[22] Filed: May 21, 1990

Related U.S. Application Data

[63] Continuation of Ser. No. 316,347, Feb. 28, 1989, abandoned.

[51] Int. Cl.[5] ..... G21K 1/04

[52] U.S. Cl. ..... 378/150; 378/4; 378/147

[58] Field of Search ..... 378/4, 86, 149, 7, 19, 378/148

[56] References Cited

U.S. PATENT DOCUMENTS 3,197,638 7/1965 Sinclair ..... 250/83.3
3,978,336 8/1976 Roux ..... 250/366
4,809,312 2/1989 Annis ..... 378/87

FOREIGN PATENT DOCUMENTS 2461877 7/1976 Fed. Rep. of Germany .

OTHER PUBLICATIONS

"AS&E's ZT Technology: A New Method for the X-ray Imaging of Defects", *AS&E News*, Jul./Aug./Sep. 1987.

Herr et al, "An X-Ray Flying Spot Scanning System for Non-Invasive Cardiac Surface Imaging", *Proceedings of the Thirteenth Annual Northeast Bioengineering Conference*, 1987, pp. 526-529.

Guzzardi et al, "90° Compton Scattering Tomography of the Lung: Detection Characteristics and Correction of the Attenuation", *The Journal of Nuclear Medicine and Allied Sciences*, vol. 24, No. 3-4, 1980, pp. 163-169.

Moretti et al, "90° Compton Scattering Tomography. Its Implementation by Means of Bar Detector Scintigraph", *The Journal of Nuclear Medicine and Allied Sciences*, vol. 24, No. 3-4, 1980, pp. 111-119.

*Primary Examiner*—Janice A. Howell
*Assistant Examiner*—Don Wong
*Attorney, Agent, or Firm*—Pollock, Vande Sande & Priddy

[57] ABSTRACT

Tomographic imaging is implemented by providing a source of penetrating radiation, means for forming a pencil beam and sweeping the pencil beam over a line in space, a radiation detector and a beam length collimator. The beam length collimator lies outside of the sweep plane defined by the sweeping motion of the pencil beam and has a plane of symmetry which intersects the sweep plane at an angle which may or may not be a right angle. The beam length collimator defines a sensitive volume which has a dimension along the length of the pencil beam where the selected slice is defined by (or partly by) a dimension of the pencil beam. The combination of the beam length collimator and the pencil beam define a sensitive volume from which scattered energy can pass the collimator and be detected. The beam length collimator preferentially detects energy scattered by the sensitive volume. The sweep of the pencil beam allows a line image representing a plurality of sensitive volumes within the sweep plane at a focal distance from the beam length collimator. By providing relative motion between the object and the source/detector/collimator arrangement, a tomographic image of the selected slice can be created. The beam length collimator allows the sensitivity of the imaging arrangement to be tailored to anomalies or cracks lying parallel to a surface of a longitudinally extending object or parallel to a circumference of a cylindrical object.

22 Claims, 8 Drawing Sheets

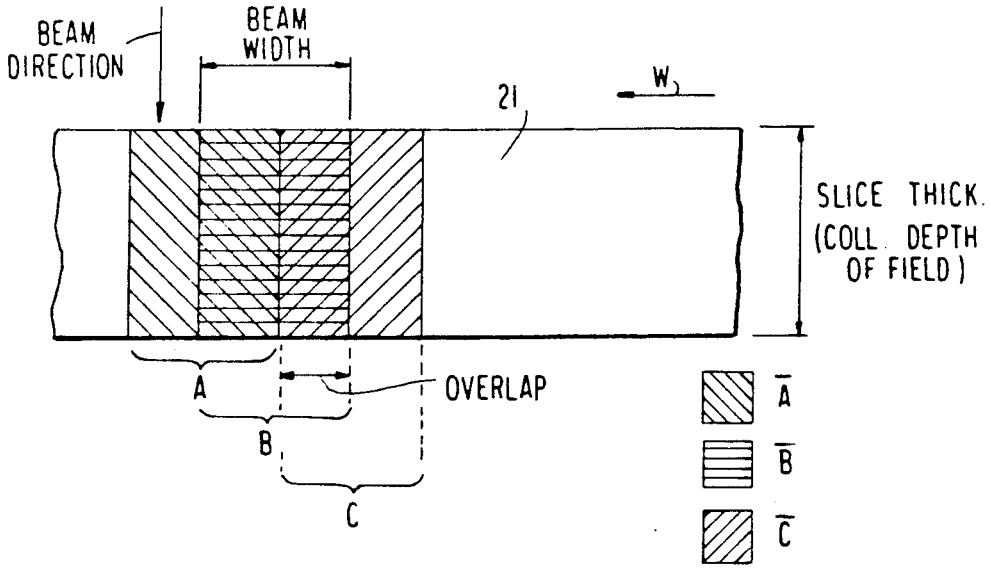
FIG.5
FIG.6
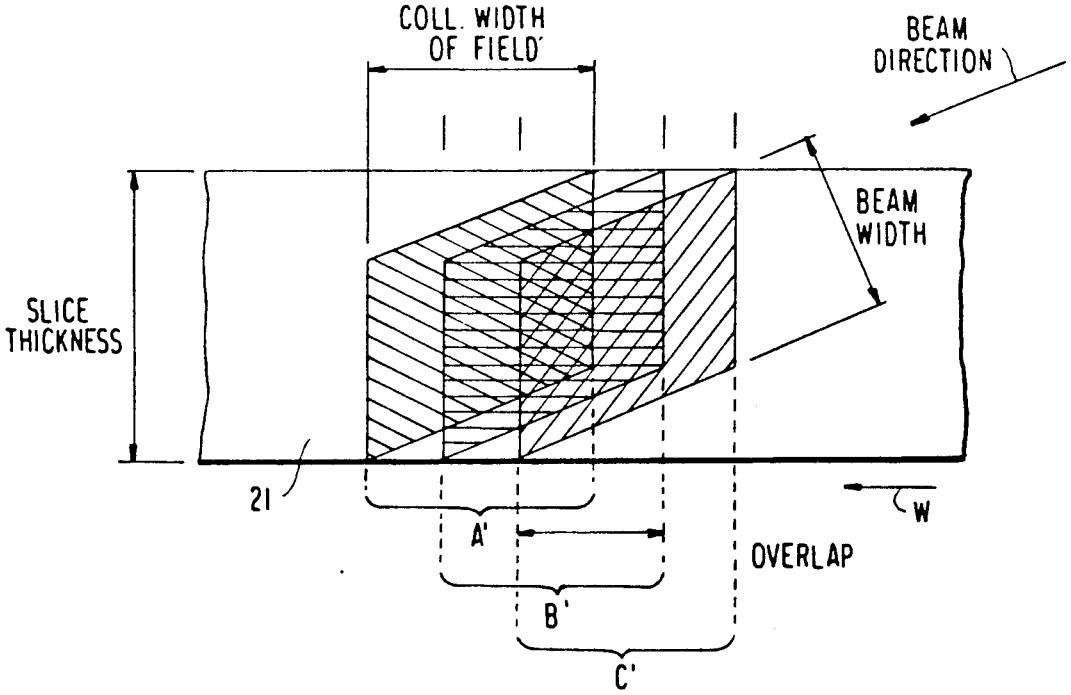

TOMOGRAPHIC IMAGING WITH IMPROVED COLLIMATOR

This is a continuation of copending application Ser. No. 07/316,347 filed on Feb. 28, 1989 now abandoned.

DESCRIPTION

1. Technical Field

The invention relates to tomographic imaging using penetrating radiant energy and more particularly to production of tomographic images which do not require use of image reconstruction techniques such as used in conventional computed tomography.

2. Cross-Reference to Related Application

The present invention is an improvement of the invention described in Annis application Ser. No. 888,019 for Tomographic Imaging, the disclosure of which is incorporated herein by this reference.

3. Background Art

An improved form of tomographic imaging is described in the cross-referenced application. As used herein, the term "tomography" or "tomographic imaging" represents imaging a selected slice of an object where the slice may or may not be planar; the term is analogous to laminography or planigraphy. The apparatus described in the- copending application includes a source of penetrating radiant energy to illuminate the object to be imaged, a sweep arrangement to form a pencil beam and to sweep the pencil beam over a line in space to form a sweep plane, some apparatus to support the object to be imaged so that the sweep plane intersects the selected slice of the object to be imaged, a radiation detector to detect energy scattered by the object, and a collimator. In the cross-referenced application the collimator is described as a line collimator because it is constructed to focus on or in the immediate vicinity of a line in space. By arranging the sweep plane to intersect the selected slice in or along the focal line of the collimator, an essential characteristic of tomographic imaging is satisfied. That essential characteristic is some way to localize or focus in on energy scattered by a single elementary volume of the object being imaged in preference to radiation scattered by other portions of the object. Since the illumination travels a linear path which is arranged to intersect the object, there are many elementary volumes of the object along that linear path which may scatter energy. If all or a significant portion of that scattered energy were detected, there would be no way to determine which of the energy was scattered by one elementary volume in preference to others. The line collimator performs a part of this localizing process by focusing on a line which can be considered the locus of a plurality of elementary volumes of the object. The focal line of the collimator is arranged so that it lies within the selected slice. In this fashion, energy scattered by elementary volumes of the object which do not lie within the selected slice is filtered. Because the pencil beam exists only at one path within the sweep plane, at any instant of time, the completion of the localizing function is effected. More particularly, while the collimator can accept energy scattered by any elementary volume lying along the preferential line, the pencil beam illuminates only a single elementary volume lying along the preferential line at any instant in time. An image of all the elementary volumes lying along the preferential line is formed as the pencil beam sweeps along the preferential line. At different instants in time, different ones of the elementary volumes along this preferential line are illuminated and energy scattered by the different elementary volumes lying along the preferential line are detected one after the other. The scattered energy which passes the collimator is detected and processed, sampled, digitized and stored. Thus as the pencil beam sweeps the line in space a line image is created in the digital memory storing the processed signals. A tomographic image of the entire slice is created by providing relative movement between the object and the imaging apparatus so the preferential line coincides with different linear segments of the selected slice as the relative motion displaces the selected slice relative to the imaging apparatus.

In the copending application the sweep plane coincides with a plane of symmetry of the collimator, and the collimator is located between the source of illuminating radiation and the object being imaged. This arrangement works well (i.e. it is sensitive) for features in the selected slice which lie generally parallel to the sweep plane. However, the arrangement has a number of disadvantages.- As described in the copending application, it is important to collect as much of the scattered energy as possible. However, the parameters of the collimator determine the slice thickness and this requires that the channels of the collimator (defined between adjacent pairs of vanes) near the plane of symmetry be relatively narrow. The thin channels reduce the scattered flux which is accepted. This reduction can be understood by considering the need for thin channels and the practical limits on the thickness of the plates between which the channels are defined. The need for thin channels and the practical limits on plate thickness results in a minimum ratio of open area of the collimator's face to the blocked area of the face. Furthermore, the need to split the collimator so as to allow the sweep plane to pass through the collimator also reduces the effective solid angle subtended by the collimator at the selected slice.

The present invention arranges the sweep plane so it does not coincide with a plane of symmetry of the collimator. In accordance with the present invention the slice thickness is defined not by the dimensions of the collimator, but by the illumination or pencil beam itself. This eliminates the constraint on the spacing of the vanes, for example it allows the spacing of the vanes which define the collimator to be made equal. Furthermore, depending on the orientation of the sweep plane relative to the plane of symmetry of the collimator, the solid angle subtended by the collimator can be significantly increased even as compared to the apparatus described in the copending application. For example in one embodiment of the invention the sweep plane is arranged to be substantially perpendicular to a plane of symmetry of the collimator. In another embodiment of the invention the sweep, plane makes an angle other than 90° with a plane of symmetry of the collimator.

The present invention has an additional advantage over the arrangement shown in the copending application in that x-ray photons which are "doubly scattered" (scattered twice) will not be detected with as high an efficiency as they would be in the arrangement of the copending application for a collimator with the same number of sheets or veins. Double scattered x-ray photons may pass through the collimator and enter the detector even though they do not suffer their first or second scatter along the focal line (the preferential line). The only requirements are that the second scatter take place within the acceptance wedge of the collimator and that the final angle of the second scatter be parallel to the extended line of the collimator plate (vein or sheet) which intersects the point of the second scatter. Since the x-ray beam in accordance with the present invention does not intersect the acceptance wedge of the collimator except at the focal line or preferential line (see FIG. 2 or 3), the first scatter, in order to generate a detected photon, must position the photon into the acceptance wedge in order for the photon to pass through the collimator after the second scatter.

More particularly, the imaging apparatus in accordance with the invention is arranged to produce a tomographic image of a selected slice and includes a source of penetrating radiation and a sweep means for forming energy from the source into a pencil beam and for repeatedly sweeping the pencil beam over a line in space. The motion of the pencil beam defines a sweep plane which defines, at least in part, the size and location of the selected slice. There is means for supporting an object to be examined so the pencil beam and sweep plane intersect the object. Further means are provided for preferentially detecting radiation scattered, at any instant, by one of a group of selected volume elements in the slice, the second means subtending a large solid angle relative to the selected volume element, the second means including:

radiation detector means developing at any instant in time a single signal reflecting radiation impinging on the radiation detector means, and a collimator located between the object and the radiation detector means, the collimator including:

a plurality of radiation transmitting channels collectively establishing a field of view which intersects the sweep plane in a linear segment which is a locus of said selected volume elements so that the collimator passes radiation scattered by different elementary volume elements of the object lying along the linear segment as the sweep illuminates the different volume elements and where the collimator has an axis of symmetry which does not coincide with the sweep plane.

Generally there is the desire to maximize the scattered energy which is detected without compromising the localizing function. This is accomplished by maximizing (or at least increasing) the solid angle subtended by the detector or collimator. Preferably the solid angle is within range of $0.05\pi$ to $2\pi$ steradian, or larger; a typical angle is $\pi/2$ steradian.

Depending on the application, there may be one or more collimators, each associated with an element of the radiation detector.

More particularly, it is a particular advantage of the invention that, at any instant, any radiation which is scattered, and which passes a suitable collimator (one which has a field of view intercepting the sweep plane in a bounded line along which the pencil beam is swept) was generated by the same elementary volume element of the object being imaged. Accordingly, wherever such scattered energy is detected, it can be used in forming the pixel representing that particular elementary volume. In some embodiments of the invention, the sweep plane is perpendicular to a plane of symmetry of the collimator, and the collimator is located only on one side of the object being illuminated. This limitation necessarily limits the solid angle subtended by the collimator to no more than $2\pi$ steradians. However, by placing a second collimator (and associated radiation detector) on the other side of the object, this limitation on the solid angle is removed and the solid angle subtended by the collimators together can approach $4\pi$. The same is true for cylindrical bodies where the selected slice lies in the cylinder wall. With cylindrical bodies, although the "second" collimator could be placed on the other side of the body, that would mean that energy scattered by the selected slice might have to travel through another cylindrical wall section before reaching the collimator/detector. It would be preferable, given a sufficient radius of curvature of the cylindrical body, to locate the "second" collimator and detector, "inside" the cylindrical object. The use of multiple collimator/detectors is not limited to embodiments in which the sweep plane lies perpendicular to a plane of symmetry of the collimator(s).

BRIEF DESCRIPTION OF THE DRAWINGS

The present invention will now be described in further detail so as to enable those skilled in the art to make and use the same in the following portions of this specification when taken in conjunction with the attached drawings in which like reference characters identify identical apparatus and in which:

FIG. 5 is a schematic of samples collected in accordance with the copending application;

FIG. 6 is a schematic of samples obtained in accordance with the invention;

DETAILED DESCRIPTION OF PREFERRED EMBODIMENTS

Figure 1:
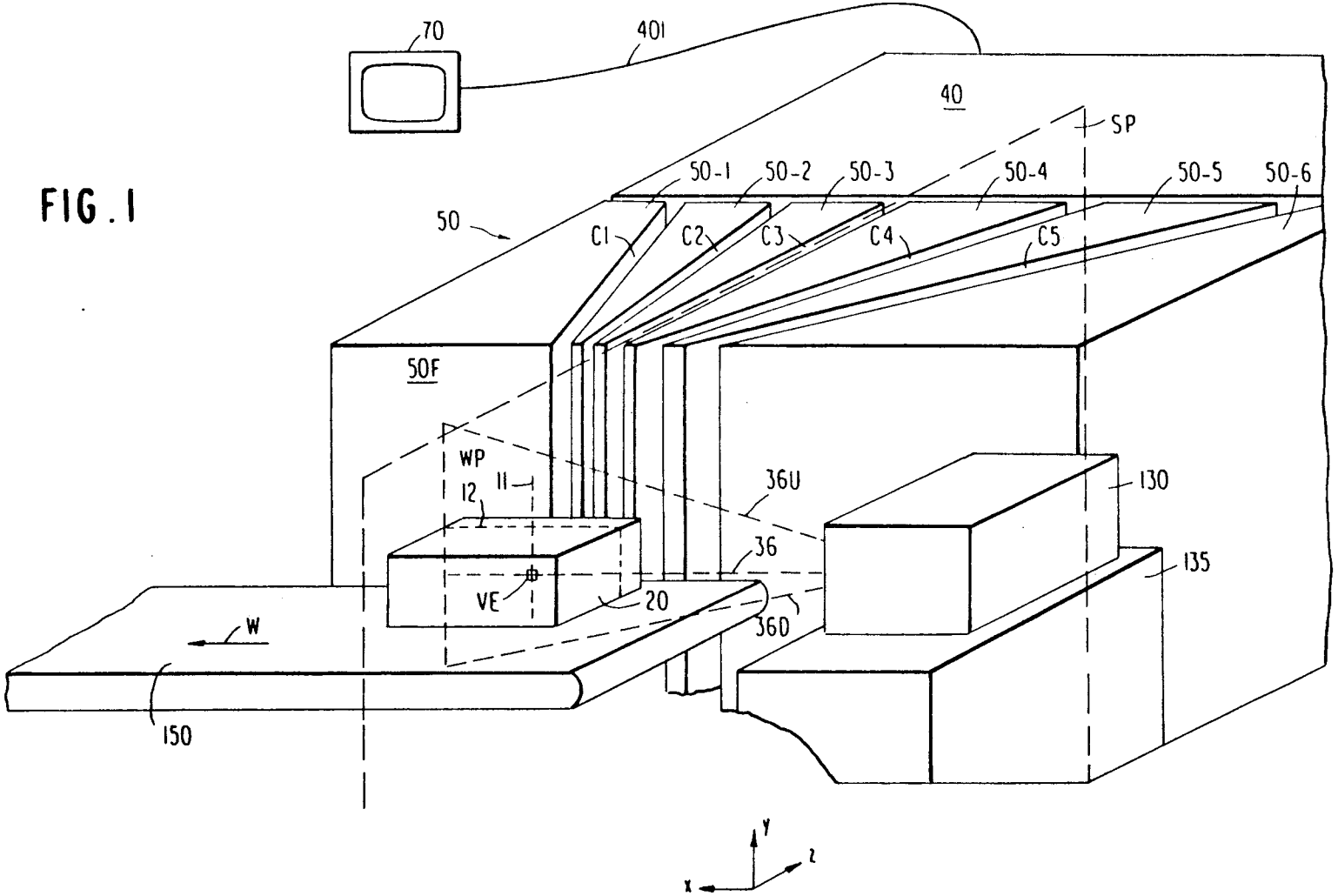
FIG. 1 is an isometric view, partially broken away, showing an embodiment of the present invention.

FIG. 1 is an isometric view, partially broken away, showing the major components of the invention. The components shown in FIG. 1 include a source of penetrating radiant energy, along with a means to form a flying pencil beam sweeping in a sweep plane, the apparatus collectively shown schematically at 130. The means used to form and sweep the pencil beam are well-known to those skilled in the art. The sweep plane is shown in dashed outline fashion, extreme rays $\mathbf{36}_U$ and $\mathbf{36}_D$ help to define the sweep plane WP. A radiation detector 40 is arranged to respond to radiant energy scattered from the pencil beam 36 by an object 20 which is located to be intercepted by the beam, in a selected slice. The slice of the object which will be imaged is identified as the slice 12. For this embodiment the slice 12 lies in or is defined by the sweep plane WP. The radiation detector 40 is any conventional radiation detector which, at any instant in time, forms a single valued signal which is determined by that portion of scattered energy passing a collimator 50 and thereafter detected. The signal generated by the detector 40 is coupled over the conductor 401 to digital processing and display electronics 70. Like the means to form and sweep the pencil beam, the digital processing and display electronics is also known to those skilled in the art. Located between the radiation detector 40 and the object 20 which is to be imaged is the collimator 50. The collimator has a plurality of radiation absorbing vanes 50-1 through 50-6. The form of the vanes is relatively arbitrary so long as they form radiation-transmitting channels, such as the channels C1 through C5. For reasons explained in the copending application, the vanes 50-1 etc. may be thin; the thickness of the vanes in FIG. 1 is exaggerated for purposes of illustration. The desire to maximize detected flux requires the "thickness" of the vanes to be reduced without compromising their function. The channels intersect the front face 50F of the collimator 50 in rectangular openings. In the direction X, each of the openings may be of identical width, and as will be described below in that case the width determines one dimension of the elementary volume element. It is not essential to use openings of either rectangular shape or of equal width. The channels C1-C5 are oriented so that theoretical extensions of the channels' planes of symmetry intersect each other in a "focal line" such as the line 11. The distance between the line 11 and the front face 50F of the collimator 50 (measured along the direction z) is referred to as the focal length F of the collimator 50. The collimator has a plane of symmetry SP, which is also shown in dashed outline in FIG. 1, and lies in the Y-Z plane as illustrated in FIG. 1. The plane of symmetry SP intersects the sweep plane WP to form the focal line 11.

With the object 20 in the position shown, the scanning pencil beam 36 will at any instant in time illuminate one elementary volume element in the slice 12 lying along the line 11, such as the exemplary volume element VE. Depending on the material existing at the location of VE, more or less of the illuminating radiation will be scattered. Ideally, all of that portion of the radiation which is scattered from the elementary volume VE in the direction of the detector 40 will (as will be described below) pass through the channels C1-C5, be detected, recorded and contribute to a tomographic image of the slice 12. As the pencil beam 36 sweeps along the line 11 other, different volume elements lying along preferential line 11 will be illuminated and the radiation response of these different volume elements will also be detected and recorded in the same fashion. In this fashion the scattering characteristics of all volume elements lying along the line 11 in the slice 12 can be detected and recorded. The object 20 is supported on the conveyor 150 for motion in the direction of the arrow W. As the object 20 moves in that direction the line 11 will overlie different linear segments of the slice 12, and in the same fashion the radiation response of different linear segments of the slice 12 will also be detected and recorded. In this fashion the radiation response of all linear segments of the slice 12 can be detected and recorded so as to build up a tomographic image of the slice 12.

It should also be apparent that at any instant the pencil beam 36 will also produce scattered energy from volume elements not along the line 11. It is the function of the beam length collimator 50 to reject such non-preferred, scattered energy.

As will be described below the vanes lying between and defining the channels C1-C5 need not have the "thickness" shown in FIG. 1 and the number of channels may be different from the number shown in FIG. 1. The reasons for this statement and some further details of the collimator 50 are described in connection with FIGS. 2 and 3.

Figure 2:
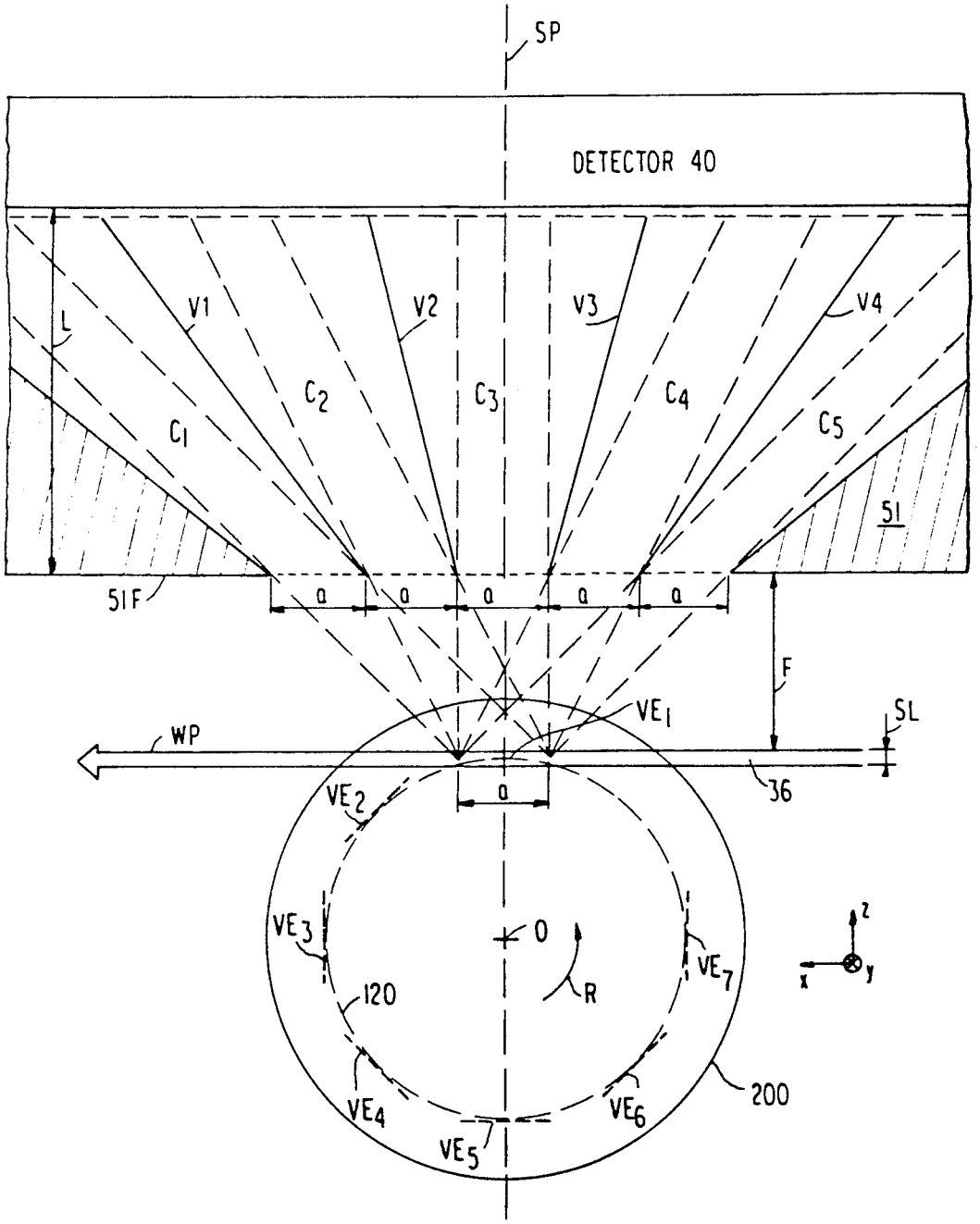
FIG. 2 is a plan view generally similar to FIG. 1 except for the form of the object being imaged, which is different in FIG. 2 from FIG. 1.

FIG. 2 is a schematic cross-section of a collimator 51 in accordance with the invention and its relation to detector 40. FIG. 2 shows imaging an object 200 whose shape is different from that of the object 20 shown in FIG. 1, however FIG. 2 is useful to explain some of the geometrical considerations of the collimator 51. The collimator of FIG. 2 can also be used with objects such as the object 20 of FIG. 1.

More particularly, as shown in FIG. 2 a cylindrical object 200 is shown being rotated about its center O. As is readily evident from FIG. 2, there is a portion of the object 200 which is located closer to the collimator 51 their is the sweep plane WP (which is seen on edge in FIG. 2). Any conventional turntable-like apparatus can be used to provide the motion in the direction R. As shown in FIG. 2 the pencil beam 36 of illuminating radiation intersects the object 200. Shown dotted in FIG. 2 is the "slice" 120 which will be imaged in accordance with this particular motion and several elementary volume elements $VE_1$-$VE_7$. The cross-section of FIG. 2 is taken in a x-z plane, e.g. as shown in FIG. 2 the y direction is perpendicular to the plane of the illustration. The section of collimator 51 seen in FIG. 2 is representative of all parallel sections of the collimator. Since the sweep plane WP is an x-y plane, the sweeping motion of the pencil beam 36 is perpendicular to the plane of the illustration. The collimator 51 shown in FIG. 2 has a number of channels C1-C5 formed by the extremities of the collimator 51 and several vanes $V_1$ through $V_4$. The vanes, as will be described below, may be extremely thin, e.g. 10 to 20 thousandths (for relatively high density, high atomic number material) at illumination energies of about 120 KVp. Using tungsten for the vanes is preferable, although other materials (such as steel) may be suitable if the x-ray energy is sufficiently low. The openings of the channels C1-C5 in the front face 51F have equal dimensions in the x direction, each opening in the channels C1-C5 is of width a. It should be apparent to those skilled in the art that radiation may be scattered from the object 200 from any volume element of the object which lies along the pencil beam 36. However, the vanes of the collimator limit the scattered energy which can reach the detector 40 to that originating from a volume element of width a at a focal distance F from the front face 51F of the collimator 51. The slice thickness SL of the volume element which can be detected is determined by the dimension of the pencil beam 36 in the Z direction, e.g. SL. Sight lines from the outer extremities of the volume element are drawn dotted for illustration purposes. The collimator 50 or 51 is referred to as a beam length collimator since the spacing of the vanes, a, defines a length along the pencil beam which is one dimension of the elementary volume whose scatter is detected.

Typically a is small compared to L and preferably the dimension F is minimized.

As shown in FIG. 2 the plane of symmetry SP of the collimator 51 forms a right angle with the sweep plane WP.

Of course it should be apparent that the important dimensions, such as the spacing a of the vanes, are selected in accordance with the particular imaging requirements. One typical imaging problem is to locate delaminations or cracks. In cylindrical bodies such as illustrated in FIG. 2, delaminations or cracks which typically are important are circumferential. For such imaging problems, the vane spacing a is selected generally to be much longer (for example three to ten times) than the slice thickness, SL. For example, while the slice thickness SL might be 0.5 mm, the vane spacing could be 3-10 mm. The beam length collimator as described herein has a further advantage over the collimator described in the copending application when imaging dense materials. Imaging dense materials requires higher beam energies than would be required for imaging less dense materials. The typical scattering characteristic becomes more and more forward peaked as the intensity of the beam energy increases. Since the beam length collimator may be sensitive to scatter in the range of ±60° measured from a perpendicular to the beam direction, the beam length collimator tends to capture more of the forward scattered energy than would the collimator of the copending application.

Figure 8:
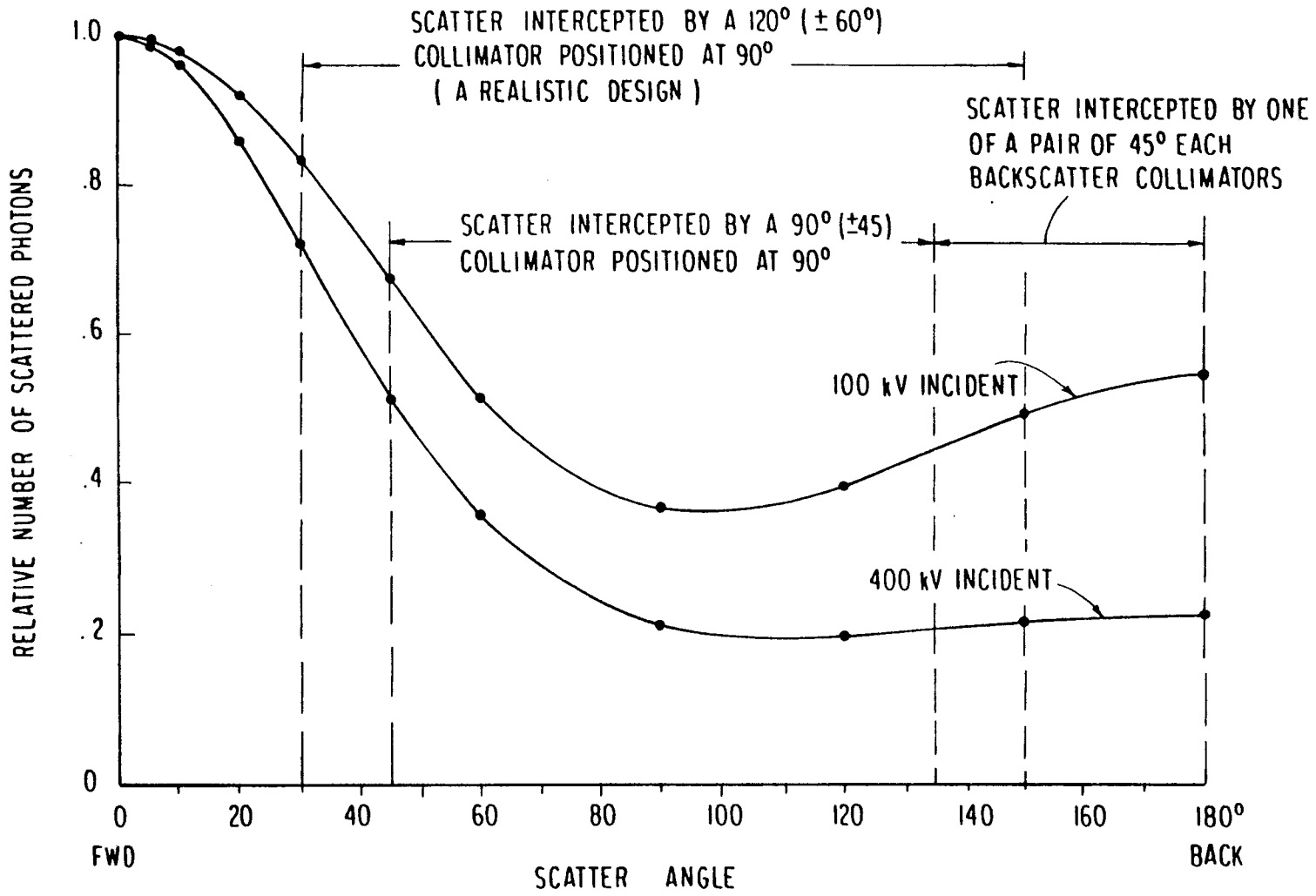
FIG. 8 plots scattered energy vs. scatter angle at beam intensities of 100 KV and 400 KV.

FIG. 8 illustrates the variation of relative number of scattered photons vs. scatter angle for energies of 100 KV and 400 KV. Focusing first on the region representing 135° to 180° (where 180° represents scatter directly back toward the source) it will be apparent that as the incident energy increases, there is a reduction in the backscattered flux. FIG. 8 also makes clear the increase in scatter as the collimator is rotated from a position as described in the copending application (in the region 135° to 180°) to the region described herein represented by the collimator positioned at 90° (for acceptance in the region 30° to 150°).

Finally, the beam length collimator provides a unique view of the interior of the object being imaged as will be described.

Figure 3:
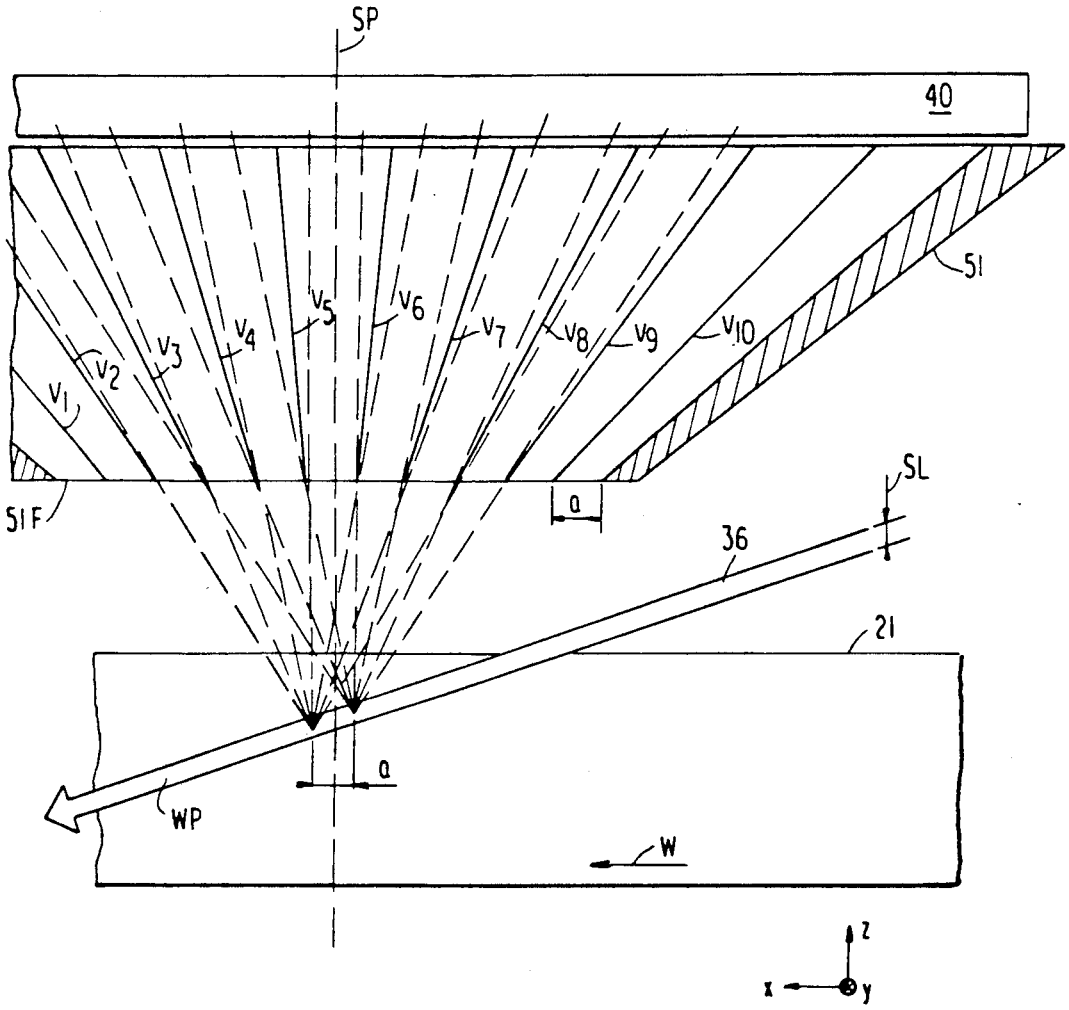
FIG. 3 is a plan view of a different embodiment of the invention.

FIG. 3 is an illustration of another embodiment of the invention. FIG. 3 is a section taken under similar conditions to the section of FIG. 2. There are two substantial differences between the embodiments of FIGS. 2 and 3. In the embodiment of FIG. 3 the object 21 being imaged moves longitudinally in the direction of the arrow W, in the x direction. The sweep plane WP forms an angle with the direction W, and furthermore plane WP forms a non-right angle with the plane of symmetry SP of the collimator 51.

Figure 4:
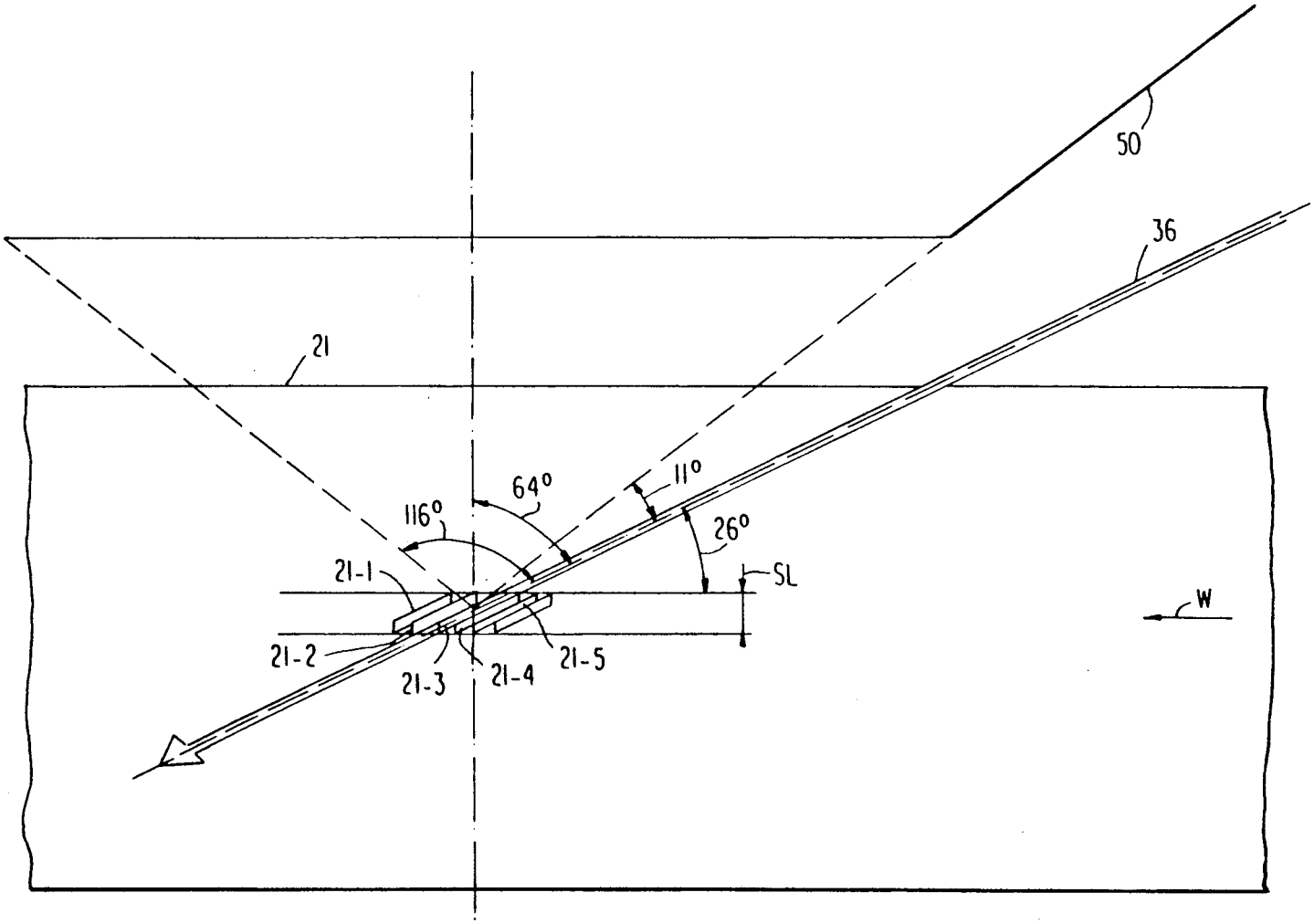
FIG. 4 is a plan view similar to FIG. 3 but showing the relationship of several sample volume elements.

The geometry shown in FIG. 3 is particularly useful for objects with flat surfaces or surfaces with a very large radius of curvature. FIG. 4 is similar to FIG. 3 but drawn to emphasize the physical relation between volume elements which are adjacent each other in the direction of motion W of the object 21. These different volume elements can be considered adjacent samples. In FIG. 4, the angle between the pencil beam 36 and a surface of the object is about 26°. Successive views or samples are shown as 21-1 through 21-5. Each of the samples are "slanted" and the slice thickness is defined both by the cross-section of the beam 36 and the angle of incidence of the beam with respect to the object, 21.

Because of the angle at which the pencil beam 36 enters the object 21, the volume of an elementary volume to which the detector 40 will respond is about three times larger than would be the case in accordance with the geometry described in the copending application for equal cross-section of the pencil beams and at the same collimator dimensions. In order to visually compare the size of the elementary volume, reference is made to FIGS. 5 and 6. FIG. 5 is a plan view drawn to illustrate imaging in accordance with the copending application. FIG. 5 also shows, relative thereto, the beam direction and direction of relative motion W. FIG. 5 represents the relationship between three different "views", each view representing an entire linear segment of the object. The different views are obtained by the relative motion between the object and the source and detector. The three views of FIG. 5 are labelled A, B and C, and the plan view of FIG. 5 is hatched (using the legends shown at $\overline{A}$, $\overline{B}$ and $\overline{C}$) to indicate the area encompassed in each "view". FIG. 6 is a similar view, using the same type hatching for views A', B' and C' in accordance with the present invention. FIG. 7 is drawn in the case the object 21 has the motion in the direction of the arrow W (see FIG. 3). Comparing FIGS. 5 and 6, it will be appreciated that:

1) There is more overlap in the different views in accordance with this invention than there was in the arrangement shown in the copending application.

2) The slice thickness is principally dependent on beam width and angle, and can be reduced without affecting the dimensions of the collimator and hence can be smaller than is the case in connection with the copending application. This results in a smaller "partial volume" effect.

3) The effect of items 1) and 2) produces more scattering per unit volume (neglecting absorption to which the beam is subjected on its way into the object).

4) And as a result the imaging is more effective for cracks parallel or nearly parallel to the surface of the object being imaged.

5) Conversely, for features which are perpendicular to the surface, or radial in the case of a cylinder, the imaging arrangement in the copending application is superior.

Figure 7B:
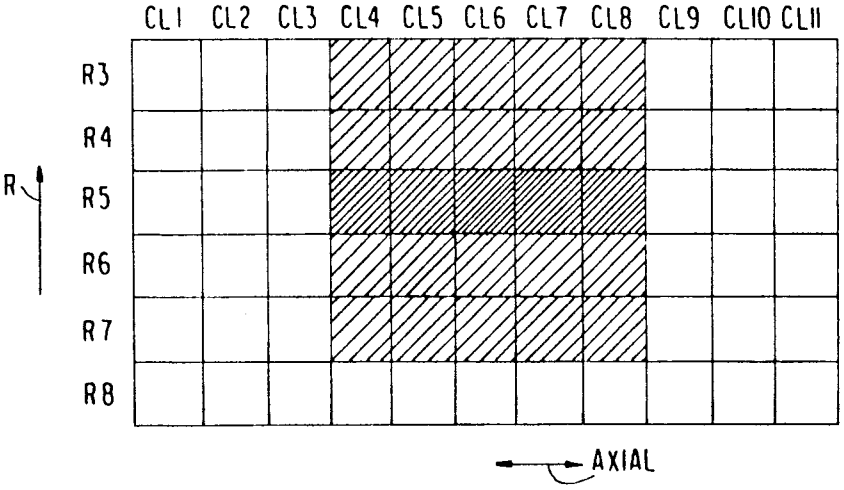
FIG. 7B illustrates the corresponding image 71.
Figure 7A:
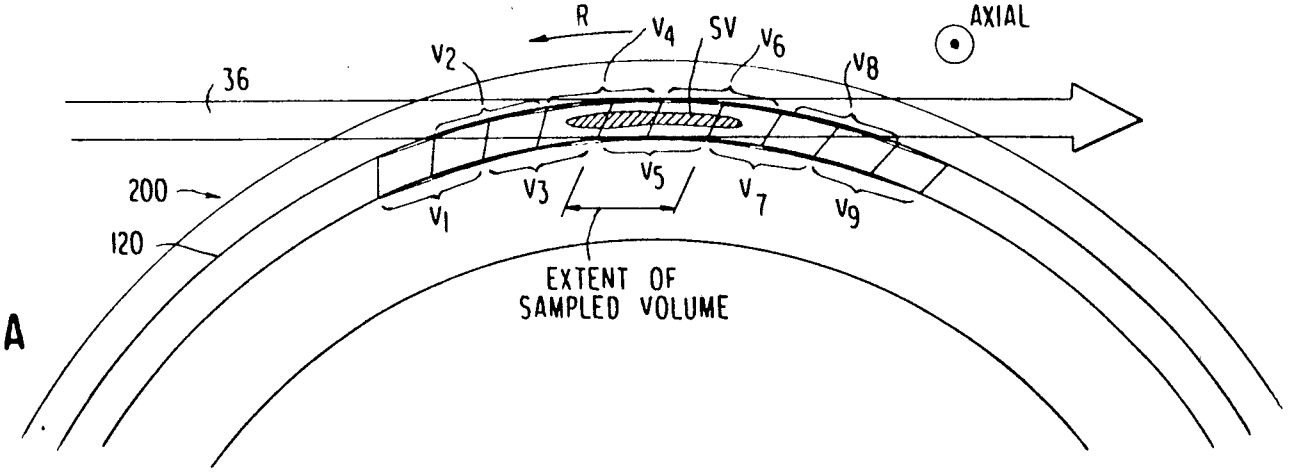
FIG. 7A is a detail of an object 200 with a circumferential delamination or crack CL.
Figure 7C:
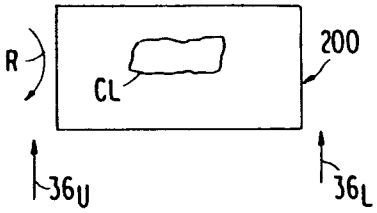
FIG. 7C shows the axial and rotation diveilious relative to the object 200

FIGS. 7A-7C, similar to FIG. 2, are useful in illustrating the unique image which is created in accordance with the present invention. FIG. 7A illustrates an object 200 being imaged (cylindrical object, such as is also shown in FIG. 2) in which the slice being imaged is represented at 120. As illustrated in FIG. 7A, nine different views (V1-V19) are illustrated, where views V3-V7 include some portion of the crack or delamination SV. The image seen in FIG. 7B is broken down into a plurality of pixels which are identified as existing in one of several rows, including rows R3-R8 and several columns CL1-CL11. The relative motion (between object and source/detector) is again denoted by the arrow R, to indicate that the object 200 being imaged rotates. The pencil beam 36 intercepts the object and the selected slice 120. The pencil beam 36 sweeps perpendicular to the plane of the illustration, in the axial direction (which is represented by the circled dot in FIG. 7A) so that the sweep plane WP is seen edge on in FIG. 7A. As the pencil beam 36 sweeps in the axial direction, pixels for different columns in the image of FIG. 7B are generated. The rotation, R, generates pixels in different rows in the image. FIG. 7C relates the rotation R, the axial direction (AXIAL) and the extremes ($36_U$; $36_D$) of the sweep. FIG. 7A illustrates (in a manner similar to FIGS. 5 and 6) sections of nine different views, V1-V9, which are presented sequentially to a detector, in that order. Finally, FIG. 7B correlates different pixels of an image with different views. A single view is determined by the collimator dimensions and thus for example at the instant in which the object 200 achieves the position shown in FIG. 7A, assuming that a single beam length collimator was employed, such a beam length collimator might define an extent of sampled volume or a view as that portion of the object intercepted by the pencil beam 36 within the limits of the view V5. Just prior to the time that the object rotated to the position shown in FIG. 7A, a view V4 would be effective. FIG. 7A is drawn for the condition in which successive views overlap in part. See for example the overlap between views V1 and V2, V2 and V3, etc. FIG. 7B is drawn on the assumption that the image is scanned left to right, hence time proceeds horizontally as in a conventional CRT with a Cartesian sweep wherein first one row is swept from left to right, the beam is stepped down to a succeeding for which is swept left to right, etc.

The row R5 is drawn in FIG. 7B to represent the view V5. Row R3 has the pixels in columns CL4–CL8 strongly hatched to represent the extent of the delamination SV in the axial direction.

Because, however, a portion of the material sampled in view V5 is also sampled in views V4 and V6, the corresponding rows (R4 and R6) of FIG. 7B are also hatched, although not as strongly as is R5. Likewise, since in the illustration of FIG. 7A the crack or delamination SV extends into the views V3 and V7, the corresponding rows (R3 and R7) are also hatched, although still more lightly than the rows R2 and R4.

The illustration of FIG. 7B illustrates an advantage of the invention in imaging small cracks or delamination whose major dimension is circumferential. Because the beam traverses a path substantially parallel to the defect, the volume occupied by the defect is relatively large compared to the total pixel volume. This ratio is called the "partial volume" and may be increased by decreasing the beam width. Those skilled in the art will understand that this has the effect of increasing the sensitivity of the detected signal to the defect or anomaly. In this way, an imaging system in accordance with the invention is more sensitive to anomalies having a major dimension parallel to a surface of the object than the arrangement shown in the co-pending application. Furthermore, its sensitivity may be increased by making the beam width smaller or by adapting the geometry to have the beam more nearly parallel to the object's surface.

Figure 9:
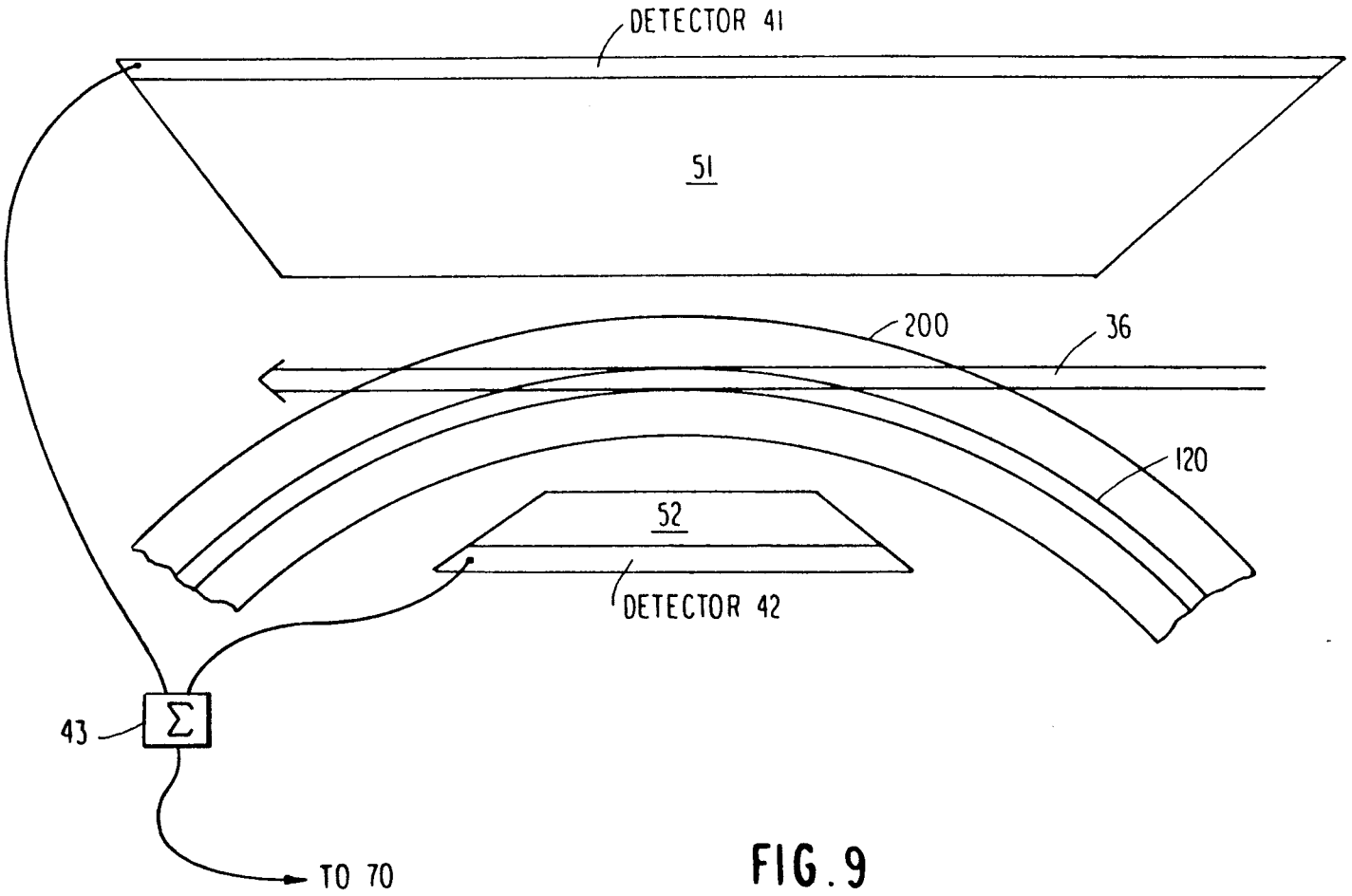
FIG. 9 is a plan view showing the use of a beam length collimator (and associated detector) on two "sides" of the selected slice 120.

FIG. 9 illustrates an example where the collimating system includes two separate collimators 51 and 52, one located on either side of the selected slice, each collimator associated with a corresponding detector component. More particularly, in the example shown in FIG. 9, a slice 120 within cylindrical object 200 is being imaged by the pencil beam 36 which sweeps in a plane perpendicular to the plane of the illustration. Similar to FIG. 2, a detector 51 is located to be responsive to energy scattered "outside" the cylinder. The collimator 51 is associated with the detector 41 producing, at any instant in time, a single valued signal representing the radiation passing the collimator 51 and which is detected. However, different from FIG. 2, FIG. 9 includes a second collimator 52 associated with a detector 42. The collimator 52 responds to energy scattered from the selected slice 120 "inside" the selected slice 120. The detector 42 responds to energy passing the collimator 52 and, like the detector 41, produces at any instant a single valued signal representing the energy passing the collimator 52 and which is detected. Both the collimators 51 and 52 each have a respective field of view, and each of those field of view, like the field of view of the collimators of FIGS. 1 and 2, intersects the sweep plane in a bounded line lying within the selected slice and along which the pencil beam 36 sweeps. Thus, at any instant in time, energy scattered from the selected slice passing the collimator 51 or the collimator 52 originates from the identical elementary volume. Accordingly, the output signals from detectors 41 and 42 can be summed (shown schematically in FIG. 9 by the summing element 43 to which the output of both the detectors 41 and 42 are connected). By placing a collimator/detector component on both "sides" of the selected slice, the collimating/detecting system as a whole subtends a larger angle at the elementary volume than would have been subtended by either the collimator 51/detector 41 or the collimator 52/detector 42. Of course the same advantages are available in the event the object being imaged is not cylindrical, i.e. a second collimator/detector could be used in the arrangements of FIGS. 1 and 3.

It should be apparent from the foregoing that, in contrast to the imaging system shown in the copending application, the invention described herein, including the beam length collimator, can have its sensitivity shaped so as to be increased for anomalies or flaws lying generally along either an outer edge of a longitudinally extending object or circumferentially about a cylindrical object. While particular characteristics of various components of the invention have been emphasized, it should be understood that the arrangements described herein are exemplary and not limiting, and that many changes can be made within the spirit and scope of the invention. The scope of the invention is to be construed by the claims attached hereto.

I claim:

1. A device useful in producing a tomographic image of a selected slice of an object to be examined comprising:

a source of penetrating radiation, sweep means for forming energy from said source into a pencil beam and for repeatedly sweeping said pencil beam over a line in space to define a sweep plane, first means for supporting an object to be examined so that said pencil beam intersects said object along a path passing through said object, collimating means with a plane of symmetry forming an angle to said sweep plane for filtering radiation scattered by said object, said collimating means having:

a field of view which intersects said sweep plane in a bounded line so that said collimating means passes only radiation scattered by elementary volumes of said object lying along said bounded line, and a plurality of channels each substantially planar in form to collectively define said field of view, and radiation detector means responsive to radiation passed by said collimating means.

2. A device as recited in claim 1 wherein said collimating means has a face opposite said object, said channels of said collimating means have equal dimensions in said face of the collimating means.

3. A device as recited in claim 2 wherein said slice has a thickness determined by a dimension of said pencil beam.

4. A device as recited in claim 1 wherein said sweep plane intersects said plane of symmetry of said collimating means at about a right angle.

5. A device as recited in claim 1 wherein said sweep plane intersects said plane of symmetry of said collimating means at an angle other than 90°.

6. A device as recited in claim 1 wherein a solid angle subtended by said collimating means at an elementary volume of said object illuminated by said pencil beam and along said bounded line is about $\pi/2$ steradians.

7. A device as recited in claim 1 wherein a solid angle subtended by said collimating means at an elementary volume of said object illuminated by said pencil beam and along said bounded line is in a range of about $0.05\pi$ to $2\pi$ steradians.

8. A device as recited in claim 1 which further includes means for providing relative motion between said object and said source and further includes imaging means responsive to a signal produced by said radiation detector means for producing an image of said selected slice.

9. A device as recited in claim 1 wherein said collimating means includes first and second collimators, each collimator having a field of view which intersects said sweep plane and said object in a bounded line and a plurality of channels each substantially planar in form to collectively define said field of view, said first and second collimators spaced from each other with said sweep plane lying therebetween and wherein said radiation detector means includes a first radiation detector associated with said first collimator and a second radiation detector associated with said second collimator, each radiation detector producing, at any instant a single valued signal representing detected radiation and summing means responsive to an output of each of said radiation detectors for producing a signal representing, at any instant in time, a sum of said output signals.

10. A device as recited in claim 9 wherein a solid angle subtended by said collimating means at an elementary volume of said object illuminated by said pencil beam and along said bounded line is at least about $0.05\pi$ steradians.

11. A device as recited in claim 10 which further includes means for producing relative motion between said object and said source and further includes imaging means responsive to a signal produced by said radiation detector means for producing an image of said selected slice.

12. A device useful in producing a tomographic image of a selected slice of an object to be examined comprising:

a source of penetrating radiation, sweep means for forming energy from said source into a pencil beam and for repeatedly sweeping said pencil beam over a line in space to define a sweep plane, first means for supporting an object to be examined so that said pencil beam intersects said object, second means for preferentially detecting radiation scattered, at any instant, by a selected volume element in said slice, said second means subtending a large solid angle relative to said selected volume element, said second means including:

radiation detector means developing at any instant in time a single signal reflecting radiation impinging on said radiation detector means, and a collimator located closer to at least a portion of said object than to said sweep plane, said collimator including:

a plurality of radiation transmitting channels collectively establishing a field of view which intersects said sweep plane in a line which is a locus of said selected volume elements so that said collimator passes radiation scattered by different elementary volume elements of said object lying along said line as said sweep of the pencil beam illuminates the different volume elements lying along said line, and wherein said collimator has an axis of symmetry which does not coincide with said sweep plane.

13. A device as recited in claim 12 wherein said channels of said collimator have equal dimensions in that face of the collimator facing said object.

14. A device as recited in claim 13 wherein said slice has a thickness determined by a dimension of said pencil beam.

15. A device as recited in claim 12 wherein said sweep plane intersects said plane of symmetry of said collimator at about a right angle.

16. A device as recited in claim 12 wherein said sweep plane intersects said plane of symmetry of said collimator at an angle other than 90°.

17. A device as recited in claim 12 wherein said solid angle is about $\pi/2$ steradians.

18. A device as recited in claim 12 wherein said solid angle is in a range of about $0.05\pi$ to $2\pi$ steradians.

19. A device as recited in claim 12 which further includes means for producing relative motion between said object and said source and further includes imaging means responsive to a signal produced by said radiation detector means for producing an image of said selected slice.

20. The device as recited in claim 12 wherein said second means includes second radiation detector means developing at any instant in time a single signal reflecting radiation impinging on said second radiation detector means, and a second collimator located between said object and said second radiation detector means, said second collimator including a plurality of radiation transmitting channels collectively establishing a field of view which intersects said sweep plane in a line which is a locus of said selected volume elements so that said collimator passes radiation scattered by different elementary volume elements of said object lying along said line as said sweep of said pencil beam illuminates the different volume elements lying along said line and wherein said second collimator has an axis of symmetry which does not coincide with said sweep plane, said radiation detector means and said collimator, on the one hand, and said second radiation detector means and said second collimator, on the other hand, being spaced from each other with said sweep plane and said object lying therebetween.

21. The device recited in claim 20 wherein a solid angle subtended by said first and second collimator at an elementary volume of said object illuminated by said pencil beam and along said bounded line is at least about $0.05\pi$ steradians.

22. The device recited in claim 21 which further includes means for producing relative motion between said object and said source, summing means for summing outputs of said radiation detector means and said second radiation detector means and imaging means responsive to an output of said summing means for producing an image of said selected slice.

* * * * *